US005937467A

United States Patent [19]

Kim

[11] Patent Number: 5,937,467

[45] Date of Patent: Aug. 17, 1999

[54] METHOD AND APPARATUS FOR BRAKING A WASHING MACHINE

[75] Inventor: Ji-hyun Kim, Suwon, Rep. of Korea

[73] Assignee: Samsung Electronic Co., Ltd., Rep. of Korea

[21] Appl. No.: 09/042,580

[22] Filed: Mar. 17, 1998

[30] Foreign Application Priority Data

Mar. 20, 1997 [KR] Rep. of Korea ..... 97-9587

[51] Int. Cl.[6] ..... D06F 33/02

[52] U.S. Cl. ..... 8/159; 68/12.02; 68/12.14; 68/12.16

[58] Field of Search ..... 8/159; 68/12.02, 68/12.14, 12.16, 12.26; 192/136; 210/145, 146

[56] References Cited

U.S. PATENT DOCUMENTS 2,161,604 6/1939 Watts ..... 68/12.02
4,232,536 11/1980 Koseki et al. ..... 68/12.16
5,823,017 10/1998 Hapke et al. ..... 68/12.26
5,824,114 10/1998 Pyo ..... 68/12.14 X

*Primary Examiner*—Philip R. Coe
*Attorney, Agent, or Firm*—Larson & Taylor

[57] ABSTRACT

A method and apparatus for braking a washing machine, capable of enhancing a braking reliability and a braking efficiency by simultaneously or selectively applying a mechanical band brake and an electrical brake. In the washing machine, a shaft of a driving motor and a central shaft of the dehydrating tub are formed on a straight line in a single shaft structure, and a reduction gear unit, a band brake assembly and a clutch assembly are axially and successively installed. When a door of the washing machine is opened, the dehydrating tub is braked by electrically stopping the motor or by operating the band brake assembly. On the other hand, when the door is closed, the dehydrating tub is braked only by electrically stopping the motor.

6 Claims, 4 Drawing Sheets

METHOD AND APPARATUS FOR BRAKING A WASHING MACHINE

BACKGROUND OF THE INVENTION

1. Field of the Invention

The present invention relates to a method and apparatus for braking a washing machine, more particularly, to a method and apparatus for braking a washing tub and a dehydrating tub of a washing machine by simultaneously or selectively applying a mechanical band brake and an electrical brake, which results in an enhanced braking reliability and braking efficiency.

2. Description of the Related Art

Typically, a washing machine washes clothes by current of water mixed with detergent in a washing tub, and dehydrates the washed and wet clothes in a dehydrating tub by a centrifugal separating force. The washing machines may be divided into belt-driving washing machines and direct-coupled washing machines according to the manner of driving them.

In the belt-driving washing machine, a washing tub and a dehydrating tub are driven by a driving force transmitted from a driving motor through a belt and a shaft. The dehydrating tub is braked by a band brake of the shaft.

Different from the belt-driving washing machine, the direct-coupled washing machine does not utilize a belt. In the direct-coupled washing machine, a shaft of a driving motor is arranged on a straight line with central shafts of a washing tub and a dehydrating tub. The washing tub and the dehydrating tub are directly driven by the driving motor. The dehydrating tub is braked in such a manner that rotations of the dehydrating tub is stopped by an electric power of the driving motor.

The belt-driving washing machine suffers a disadvantage that it may be vibrated and oscillated during operation because a rotary shaft of the driving motor and a rotary shaft of the washing tub are not arranged on a straight line from the structural characteristics thereof. On the other hand, a shaft of a driving motor, central shafts of a washing tub and a dehydrating tub of the direct-coupled washing machine are arranged on a straight line. Accordingly, such vibration and oscillation related to the belt-driving washing machine may not occur in the direct-coupled washing machine. This results in an increased adoption of the direct-coupled washing machines.

However, the direct-coupled washing machine also suffers a disadvantage that the driving motor thereof should have a large capacity to afford the load during washing and dehydrating processes. To overcome the disadvantage, an indirect/direct coupled washing machine is provided. The indirect/direct coupled washing machine further includes predetermined reduction gears for driving a washing tub, whereby, the capacity of the driving motor that is required for the above mentioned washing machines can be reduced according to the reduction gear ratio.

Though the capacity of the driving motor can be reduced by further including the reduction gears, the indirect/direct coupled washing machine still suffers a disadvantage that, as the capacity of the motor is reduced, it is impossible to stop the dehydrating tub using an electrical brake in a safe braking time corresponding to a safe standard of a washing machine.

SUMMARY OF THE INVENTION

It is therefore an object of the present invention to provide a method and apparatus for efficiently braking a dehydrating tub of a washing machine using a driving motor having a relatively small capacity by simultaneously or selectively applying a mechanical band brake and an electrical brake.

According to the present invention, in a washing machine in which a shaft of a driving motor and a central shaft of a dehydrating tub are formed on a straight line in a single shaft structure, and a reduction gear unit, a band brake assembly and a clutch assembly are axially and successively installed, when a door of the washing machine is opened, the dehydrating tub is braked by electrically stopping the motor or by operating the band brake assembly; and when the door is closed, the dehydrating tub is braked only by stopping the motor.

In a preferred embodiment of the present invention, the stop of the motor and the operation of the band brake assembly may be carried out simultaneously or successively.

According to another aspect of the present invention, the apparatus for braking a washing machine in which a shaft of a driving motor and a central shaft of a dehydrating tub are formed on a straight line in a single shaft structure, comprises: a motor controlling unit for successively generating a predetermined brake wave form for electrically controlling the driving motor; a reduction gear unit installed on the driving motor; a band brake unit that is axially installed on the reduction gear unit; and a clutch unit which is axially and successively installed on the band brake unit.

In a preferred embodiment of the present invention, the driving motor is a three-phase switched reluctance motor.

In a preferred embodiment of the present invention, when the washing machine is turned off, the dehydrating tub is braked by the band brake unit.

DETAILED DESCRIPTION OF THE PREFERRED EMBODIMENTS

A preferred embodiment of a method and apparatus for braking a washing machine according to the present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 2:
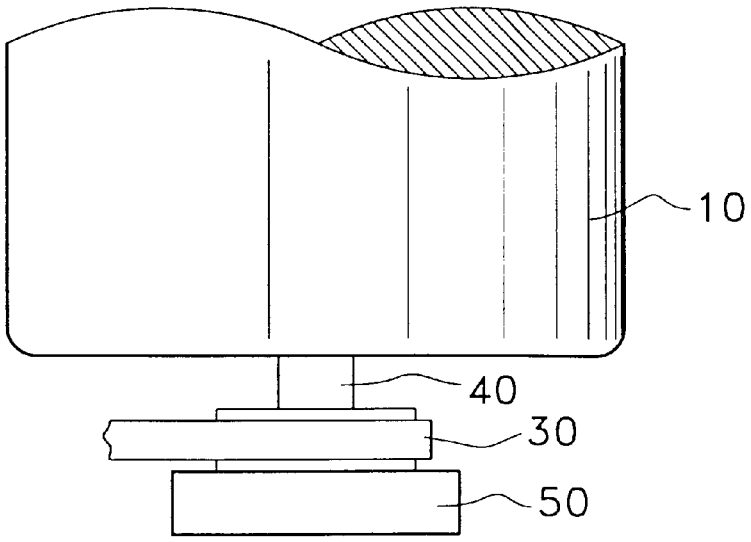
FIG. 2 is a conceptive diagram of an apparatus for braking a washing machine according to the present invention.
Figure 6:
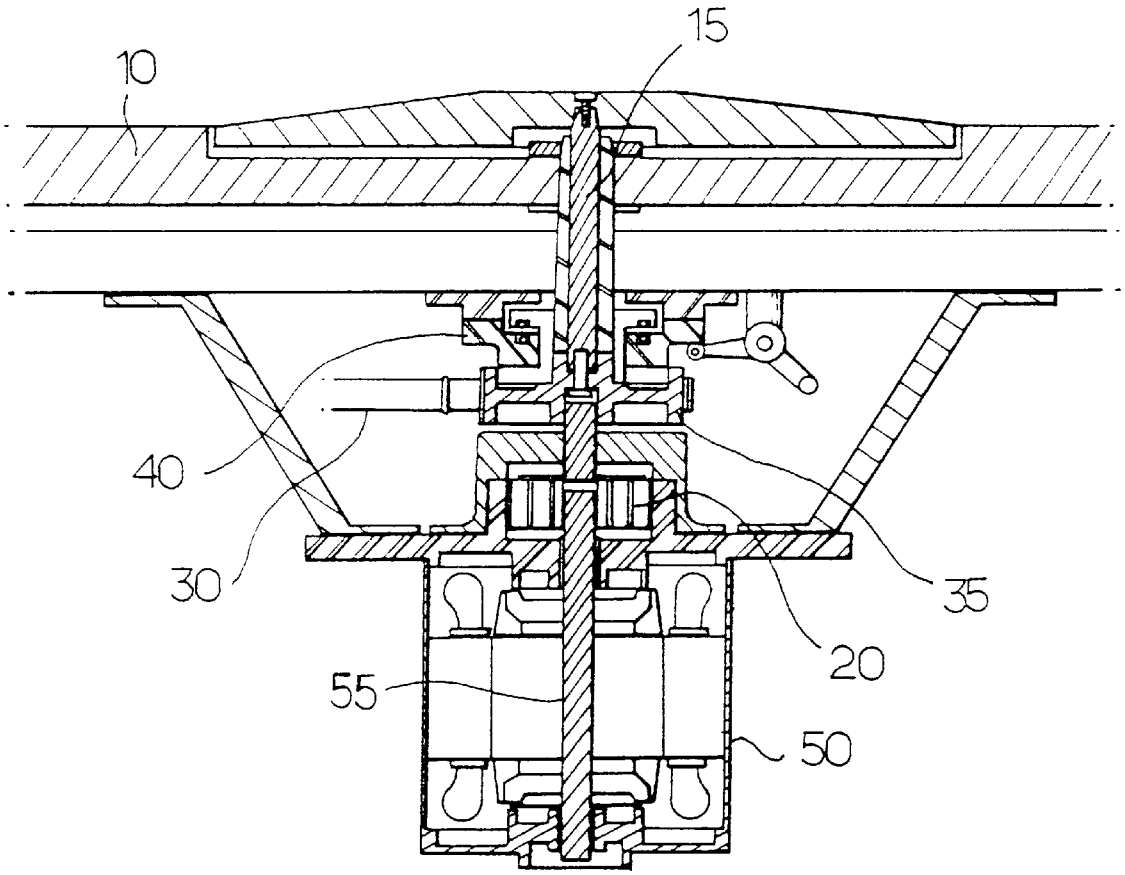
FIG. 6 is a sectional view of an apparatus for braking a washing machine according to the present invention.

According to a method for braking a washing machine according to the present invention, a dehydrating tub can be efficiently braked using a motor having a relatively small capacity by simultaneously or selectively applying a mechanical band brake and an electrical brake. As shown in FIGS. 2 and 6, a shaft 55 of a driving motor 50 and a shaft 15 of a dehydrating tub 10 are formed on a straight line in a single shaft structure. The motor 50 is a three-phase switched reluctance motor (SR motor) on which a reduction gear unit 20 is formed in a single body. On the reduction gear unit 20, a band brake assembly 30 and a clutch assembly 40 are axially and successively installed. The reference number 35 represents a brake drum of the band brake assembly 50.

Figure 1:
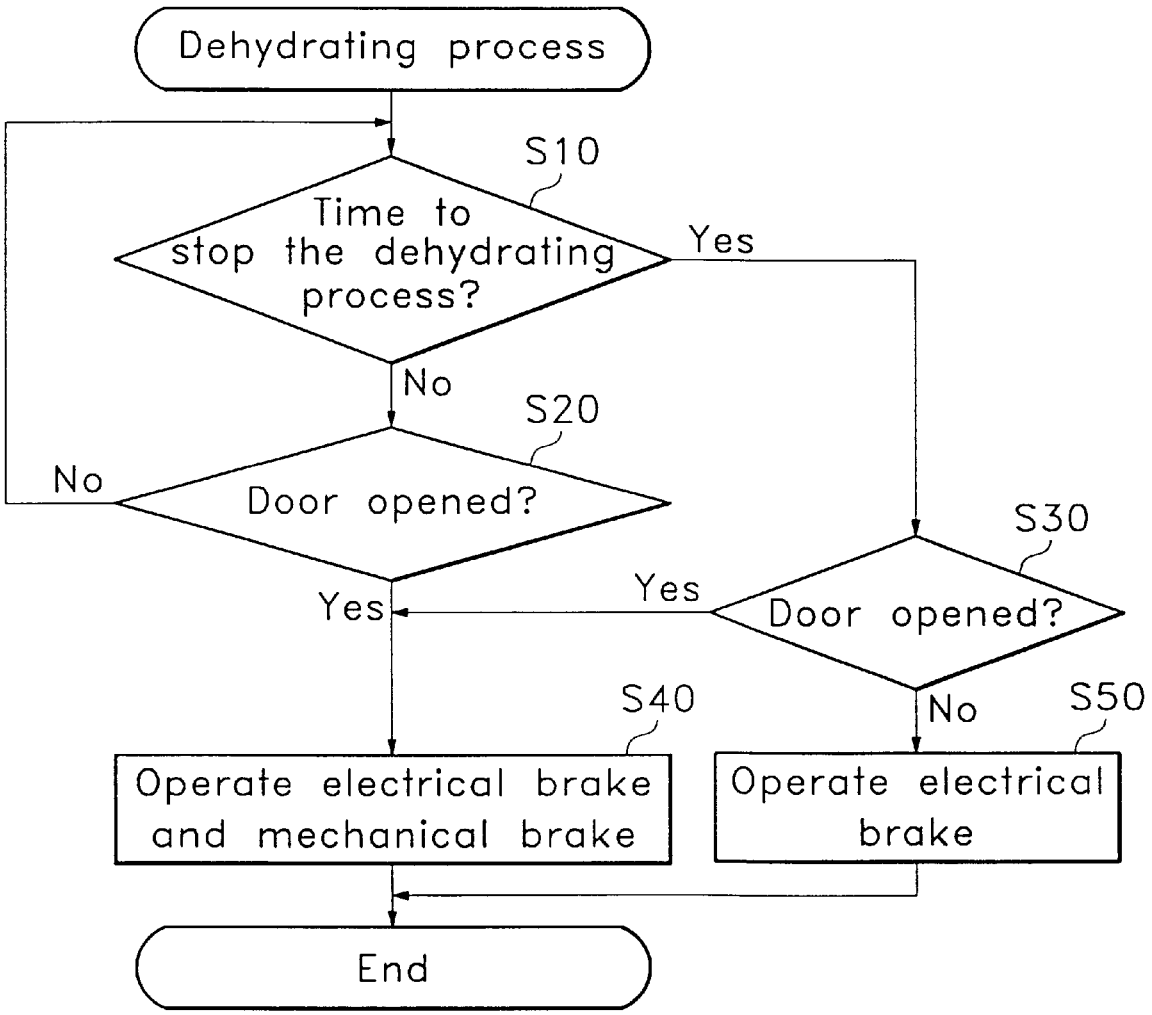
FIG. 1 is a flowchart of a method for braking a washing machine according to the present invention.

The method for braking a washing machine according to the present invention will be described with reference to FIG. 1. First, it is determined whether it is a time for stopping a dehydrating process or not at step S10. If it is determined that it is the time for stopping the dehydrating process, then, it is determined whether a door of the washing machine is opened or not at step S30. If it is determined that the door is closed, the dehydrating tub 10 is braked only by stopping the driving motor 50. This state in which it is the time for stopping the dehydrating process and the door is closed, means that a user of the washing machine has not opened the door even though it is the time for stopping the dehydrating process. Accordingly, it is not necessary to stop the dehydrating tub 10 in a safe time.

As shown by a flow through steps S11, S30 and S40, in the event that it is the time for stopping the dehydrating process and the door is opened, the driving motor 50 is stopped and the band brake assembly 30 is operated at the same time in order to rapidly stop the dehydrating tub 10. As a result, the dehydrating tub 10 can be stopped in a safe braking time. The stop of the driving motor 50 and the operation of the band brake assembly 30 may be carried out simultaneously. According to circumstances, either of them may be carried out first and the rest thereof may be followed.

Otherwise, as shown by a flow through steps S10, S20 and S40, in the event that it is not the time for stopping the dehydrating process and the door is opened, the driving motor 50 is controlled to be stopped and the band brake assembly 30 is operated at the same time in order to brake the dehydrating tub 10 in the safe braking time for protection of the user of the washing machine.

Finally, in the event that it is determined that it is not the time for stopping the dehydrating tub 10 at the step S10 and the door is not opened at the step S20, the dehydrating process is being still carried out. Then, the dehydrating process is maintained to be completed.

Referring to FIGS. 2 through 6, the structure and the operation of the apparatus for braking a washing machine according to the present invention will be described hereinafter.

Figure 4:
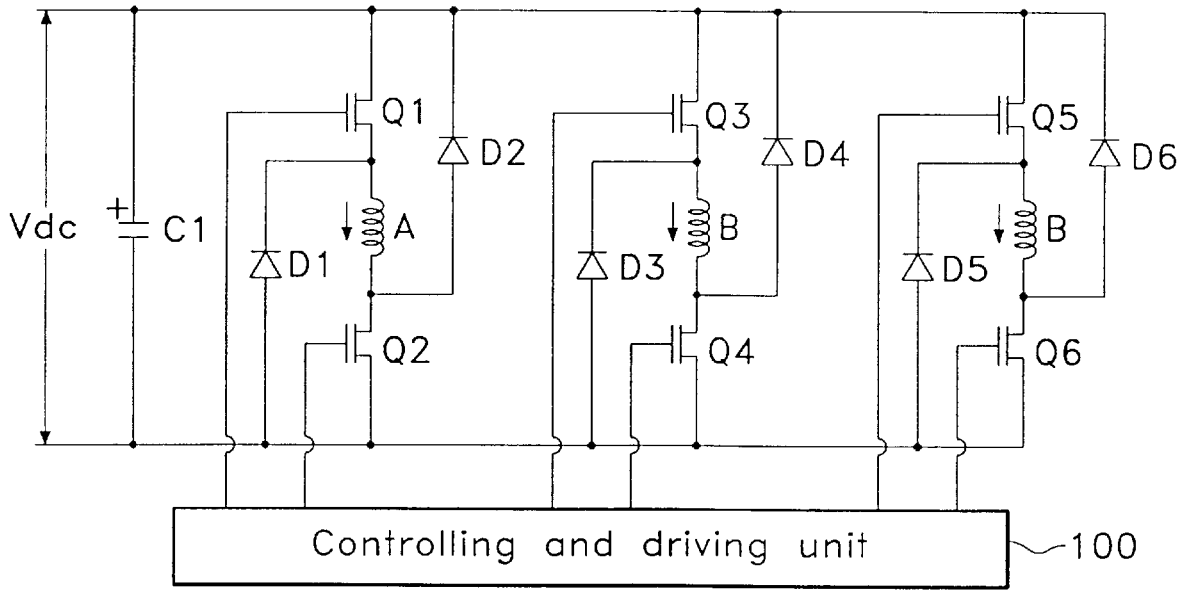
FIG. 4 is a circuit diagram for controlling a driving motor of a washing machine applied to the present invention.

FIG. 4 is a circuit diagram for driving an SR motor 50 applied to the present invention. The SR motor 50 of the present invention may be fabricated at a low cost. Accordingly, the SR motor 50 contributes to reduce costs for fabricating indirect/direct coupled washing machines. This is because that a rotor 60 of the SR motor 50 shown in FIG. 5 does not include a separate magnet or a wound wire. It is apparent that a motor that does not include a commutator and is capable of braking the dehydrating tub 10 of the washing machine by an electrical power can be also used as the motor 50 of the present invention. For description purposes, a motor driving circuit in FIG. 4 is illustrated as a circuit for a three-phase motor having three phases A, B and C. It is apparent, however, that a two-phase or a four-phase motor and motor driving circuits therefore may be also applied to the present invention.

As shown in FIG. 4, phases A, B and C of the SR motor 50 are connected to field effect transistors (FETs) Q1 and Q2, Q3 and Q4, and Q5 and Q6, respectively. Gate terminals of the transistors Q1 through Q6 are controlled by a controlling and driving unit 100. A plurality of diodes D1, D2, D3, D4, D5 and D6 are connected to a condenser C1 to return current flowing through wound wire A, B and C of the motor to the condenser C1 at a turn-off time of the transistors Q1 . . . Q6, respectively.

Figure 3:
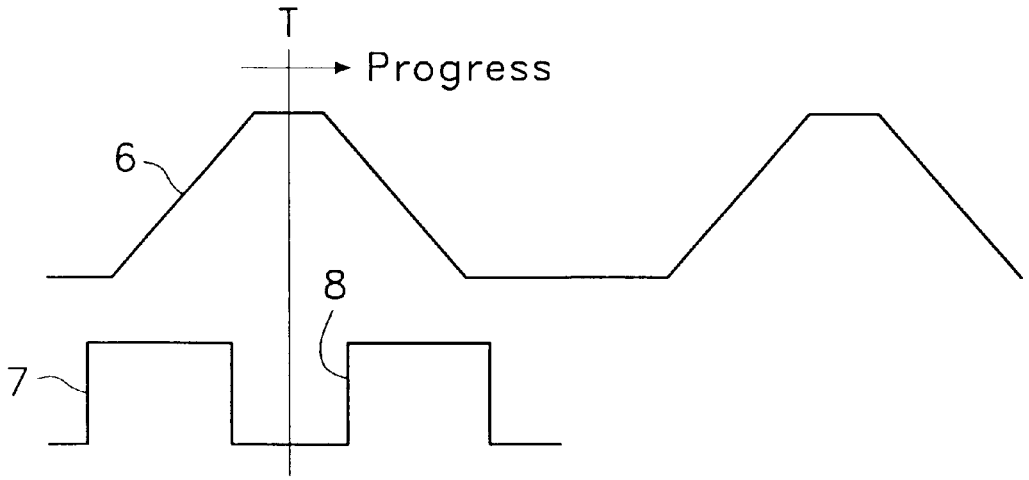
FIG. 3 is a waveform generated for controlling a driving motor of a washing machine applied to the present invention.
Figure 5:
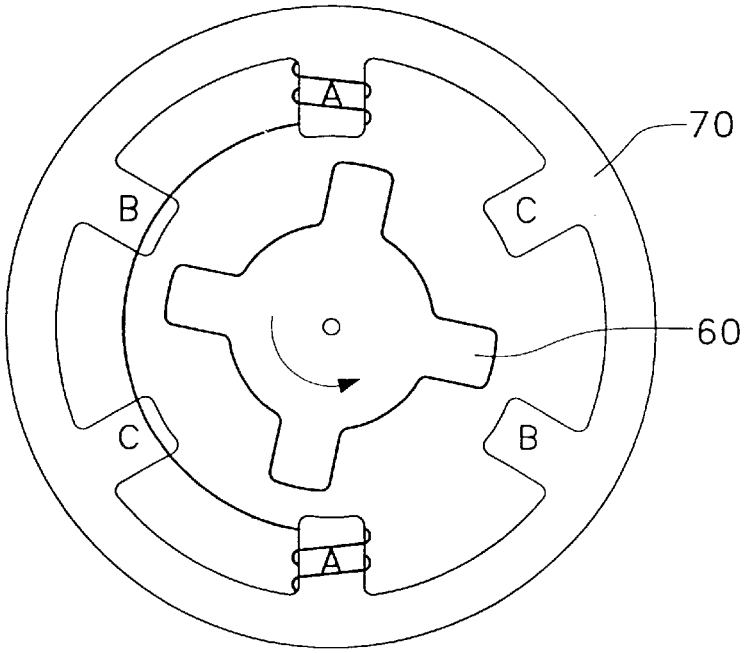
FIG. 5 is a cross sectional view of a driving motor of a washing machine applied to the present invention.

FIG. 3 shows a characteristic impedance wave form 6 of the SR motor 50, motoring signals 7 for providing the SR motor 50 with a constant rotation power, and braking signals 8 for suppressing rotations of the motor 50. In other words, a reference letter T represents a point that a stator 70 and a rotor 60 of the SR motor 50 shown in FIG. 5 are in accord with each other, and accordingly an inductance of the SR motor 50 is in its highest level. Since the motoring signals 7 increase a rotation power of the motor 50 by turning on the motor 50 before the rotor 60 and the stator 70 are in accord with each other. On the other hand, the braking signals 8 decrease the rotation power of the motor 50 by turning on the motor 50 after the rotor 60 passes by the stator 70.

The operation of the apparatus for braking a washing machine will be described hereinafter.

Referring again to FIG. 4, when the transistors Q1 and Q2 are turned on under the condition that power Vdc is supplied, current flows through a phase A of the SR motor 50. At this time, a point of the turning-on time is determined as follows. In order to increase the rotation power of the motor 50, the motor 50 is turned on at a point of time before the point T that the rotor 60 and the stator 70 are in accord with each other as shown by the wave form 8 of FIG. 3. In order to decrease the rotation power of the motor 50, the motor 50 is turned on at a point of time after the point T. The other phases B and C are turned on and off in the respective order thereof, whereby the SR motor 50 is rotated or stopped. When the motor 50 is turned off, the transistors Q1 and Q2 are accordingly turned off. At this time, the current flowing the wound wire A is returned to the condenser C1 through the diodes D1 and D2.

FIGS. 2 and 6 are a conceptive diagram and a cross sectional view of a structure of an indirect/direct coupled washing machine, respectively. Compared to a conventional belt driving washing machine, the indirect/direct coupled washing machine does not include a belt and is formed in a direct-coupled structure. Compared to a direct-coupled washing machine, the indirect/direct coupled washing machine further includes a reduction gear unit 20 and a band brake assembly 30. The reduction gear unit 20 decelerates rotations of the motor 50 and rotates a washing tub during a washing process. At this time, the reduction ratio is approximately 5:1. The result is that a number of rotations is decreased to ⅕ of the rotations of the direct-coupled washing machine and, on the other hand, the torque thereof is increased to 5 times. Accordingly, it is possible to rotate the washing tub using a motor 50 having much smaller capacitor compared to the conventional direct-coupled washing machine. For a dehydrating process, rotation power is directly transmitted to the dehydrating tub 10 without passing through the reduction gear unit 20 by an operation of a clutch 40. Thereby, the apparatus for braking a washing machine according to the present invention is capable of efficiently braking the washing machine using a motor having a relatively small capacity by applying a mechanical band brake and an electrical brake simultaneously or selectively.

As aforementioned, a method and apparatus for braking a washing machine according to the present invention provides an advantage of enhanced braking reliability and braking efficiency by applying a mechanical band brake and an electrical brake simultaneously or selectively for braking a dehydrating tub.

This invention has been described above with reference to the aforementioned embodiments. It is evident, however, that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A method for braking a washing machine in which a shaft of a driving motor and a central shaft of a dehydrating tub are formed on a straight line in a single shaft structure, and a reduction gear unit, a band brake assembly and a clutch assembly are axially and successively installed, wherein when a door of said washing machine is opened, said dehydrating tub is braked by electrically stopping said motor and by operating said band brake assembly; and when said door is closed, said dehydrating tub is braked only by electrically stopping said motor.

2. The method for braking a washing machine according to claim 1, wherein, when said door is opened, said motor and said band brake assembly simultaneously perform respective braking operations thereof.

3. The method for braking a washing machine according to claim 1, wherein, when said door is opened, said motor and said band brake assembly successively perform respective braking operations thereof.

4. An apparatus for braking a washing machine in which a shaft of a driving motor and a central shaft of a dehydrating tub are formed on a straight line in a single shaft structure, said apparatus comprising:

motor controlling means for generating a predetermined signal wave form for electrically stopping said driving motor;

reduction gear installed on said driving motor;

band brake means axially installed on said reduction gear means; and clutch means axially and successively installed on said band brake means.

5. The apparatus for braking a washing machine according to claim 4, wherein said driving motor is a three-phase switched reluctance motor.

6. The apparatus for braking a washing machine according to claim 4, wherein when said washing machine is turned off, said dehydrating tub is braked by said band brake means.

* * * * *